US010904673B1

(12) United States Patent
Zhang

(10) Patent No.: US 10,904,673 B1
(45) Date of Patent: Jan. 26, 2021

(54) HEARING AID CHARGER CASE

(71) Applicant: Xiamen Retone Hearing Technology Co., Ltd., Xiamen (CN)

(72) Inventor: Chengxiang Zhang, Xiamen (CN)

(73) Assignee: XIAMEN RETONE HEARING TECHNOLOGY CO., LTD., Xiamen (CN)

( * ) Notice: Subject to any disclaimer, the term of this patent is extended or adjusted under 35 U.S.C. 154(b) by 0 days.

(21) Appl. No.: 16/751,171

(22) Filed: Jan. 23, 2020

(30) Foreign Application Priority Data

Nov. 15, 2019 (CN) ..... 2019 2 1974089 U

(51) Int. Cl.
*H04R 5/033* (2006.01)
*H04R 25/00* (2006.01)

(52) U.S. Cl.
CPC ..... *H04R 25/305* (2013.01); *H04R 25/602* (2013.01); *H04R 25/603* (2019.05); *H04R 2225/31* (2013.01)

(58) Field of Classification Search
CPC ..... H04R 1/1025; H04R 1/2892; H04R 2420/09; H04R 25/658
USPC ..... 381/74, 323–324
See application file for complete search history.

(56) References Cited

U.S. PATENT DOCUMENTS

2020/0266640 A1* 8/2020 Valenzuela ..... H02J 7/0044

* cited by examiner

*Primary Examiner* — George C Monikang
(74) *Attorney, Agent, or Firm* — Bayramoglu Law Offices LLC

(57) ABSTRACT

The present disclosure provides a hearing aid charger case. The hearing aid charger case comprises a housing, a lining and a charger module. The housing comprises a lid body and a lower housing; the lid body and the lower housing body are pivoted to each other through a hinge; a back surface of the lower housing body is disposed with a USB interface that connects a power supply. The lining and the charger module are arranged in the lower housing body, and the lining is located above the charger module and is fixedly connected to the charger module, and the inside of the lining are provided with two charging bays. The bottom of each charging bay is disposed with two charging pins at intervals. The hearing aid charger case can charge and store two hearing aids at the same time, which is greatly convenient for the users.

7 Claims, 8 Drawing Sheets

HEARING AID CHARGER CASE

CROSS REFERENCE TO RELATED APPLICATIONS

This application is based upon and claims priority to Chinese Patent Application No. 201921974089.6, filed on Nov. 15, 2019, the entire contents of which are incorporated herein by reference.

TECHNICAL FIELD

The present disclosure relates to the technical field of hearing aids, and in particular to a hearing aid charging case.

BACKGROUND

A hearing aid is a device designed to improve hearing, like a miniature loudspeaker that amplifies a weak sound and transmit the amplified sound to an earphone such that a person's hearing loss part can hear the amplified sound. The types of hearing aids comprise behind-the-ear hearing aids, common in-the-ear hearing aids, in-the-canal hearing aid and the like.

A hearing aid needs stable supply voltage due to its specialty. Furthermore, a hearing aid mostly uses zinc-air battery. The zinc-air battery generates power through contact with the air and chemical reaction. If the zinc-air battery is exposed in the air, it starts to consume the power quickly. A hearing aid charger case emerges on the market. To charge a hearing aid, simply put the charger case on the table and place the hearing aid it. However, such charger case is used indoors, and its function is unitary.

SUMMARY

The present disclosure aims to solve technical problems in the prior art more than to a certain extent. Therefore, an objective of the present disclosure is to provide a hearing aid charger case.

To achieve the above objective, the embodiment of the first aspect for the present disclosure provides a hearing aid charger case. A hearing aid has an ear mold head and a hearing aid body. An end surface of the hearing aid body on the contact side with the charger case comprises two spaced charging contacts, a microphone hole, a volume adjustment knob and a take-out line. The charger case comprises a housing, a lining and a charger module. The housing comprises a lid body and a lower housing; the lid body and the lower housing body are pivoted to each other through a hinge; a back surface of the lower housing body is disposed with a power interface connected to power supplies, and the power supply interface is electrically connected to the charger module. The lining and the charger module are arranged in the lower housing body. The lining is located above the charger module and is fixedly connected to the charger module, and two charging bays are arranged in the lining. The bottom of each charging bay is disposed with two charging pins, a through hole, a notch and a recess. The positions of the two charging pins correspond to the positions of the two charging contacts, and each charging pin is electrically connected to the charger module. The through hole is used to accommodate the take-out line. The notch is used to accommodate the microphone. The recess is used to accommodate the volume adjustment knob.

Based on the above design, the charger case can charge and store the two hearing aids at the same time. The two hearing aids can be carried around, which is convenient for the users.

Furthermore, the hearing aid charger case provided by the embodiment of the present disclosure has the additional technical features below:

The hearing aid charger case further comprises a rechargeable battery module, and the rechargeable battery module is electrically connected to the charger module. The rechargeable battery module can supply power to the charging pins. The lower housing body is internally provided with a Hall switch and three LED sets. Each LED set comprises more than two LED beads. The Hall switch is located at the top of the lining of the lower housing body, and the Hall switch and the three LED sets are respectively welded on a flexible printed circuit (FPC) board. The FPC board is electrically connected to the charging module. A position on the lid body relative to the Hall switch is provide with a third magnetic mechanism, and the charger module further has a battery level detection module used to respectively detect the power reserve of the hearing aids and rechargeable battery module. When the lid body and the lower housing body are mutually closed, the Hall switch is influenced by a magnetic field of the third magnetic mechanism such that the Hall switch is switched on. The three LED sets indicate the battery level of monitored objects by the number of lighting LED beads turned on, i.e., one LED set is used to indicate the batter level of the rechargeable battery module, and the other two LED sets are respectively used to indicate the battery level of the two hearing aids placed in the lower housing body.

By adopting the above structure, the charger case comes with the rechargeable battery module, and three LED sets are additionally provided on the lower housing body. The LED sets are respectively used to detect the battery level of the hearing aids and also the rechargeable battery module, which allows the users to see the charging progress of the hearing aids in real time and intuitively know the battery level of the rechargeable battery module of the charger case, so as to charge the rechargeable battery module of the charger case in time.

DESCRIPTION OF THE EMBODIMENTS

Figure 1:
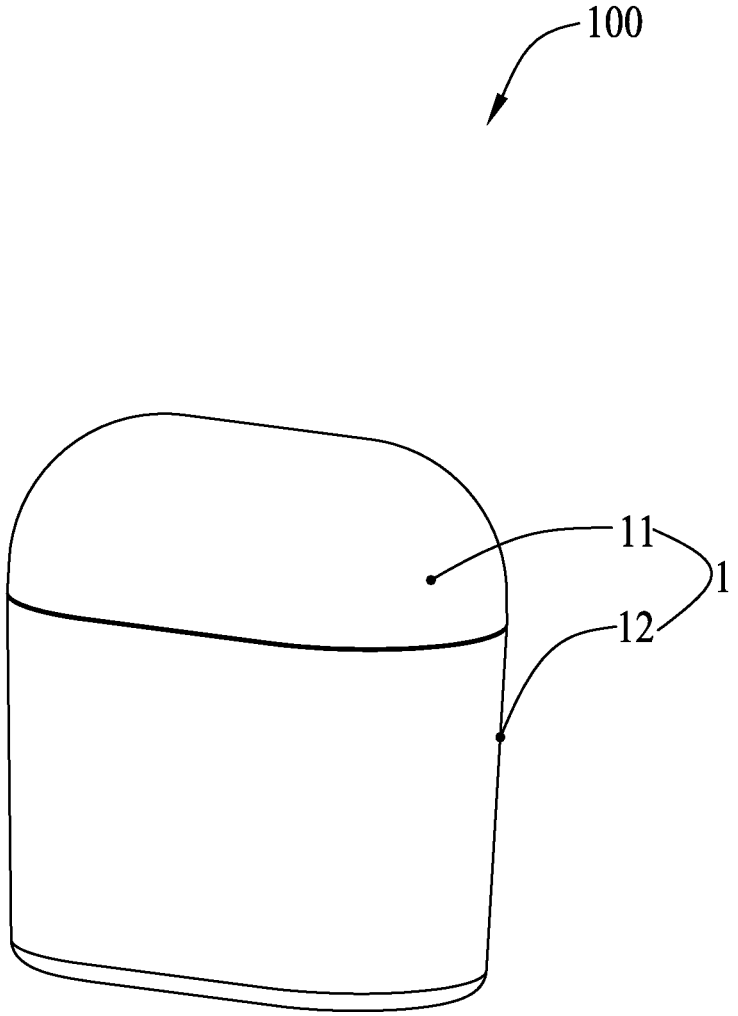
FIG. 1 is a stereo front view of a hearing aid charging charger case of the present disclosure.
Figure 2:
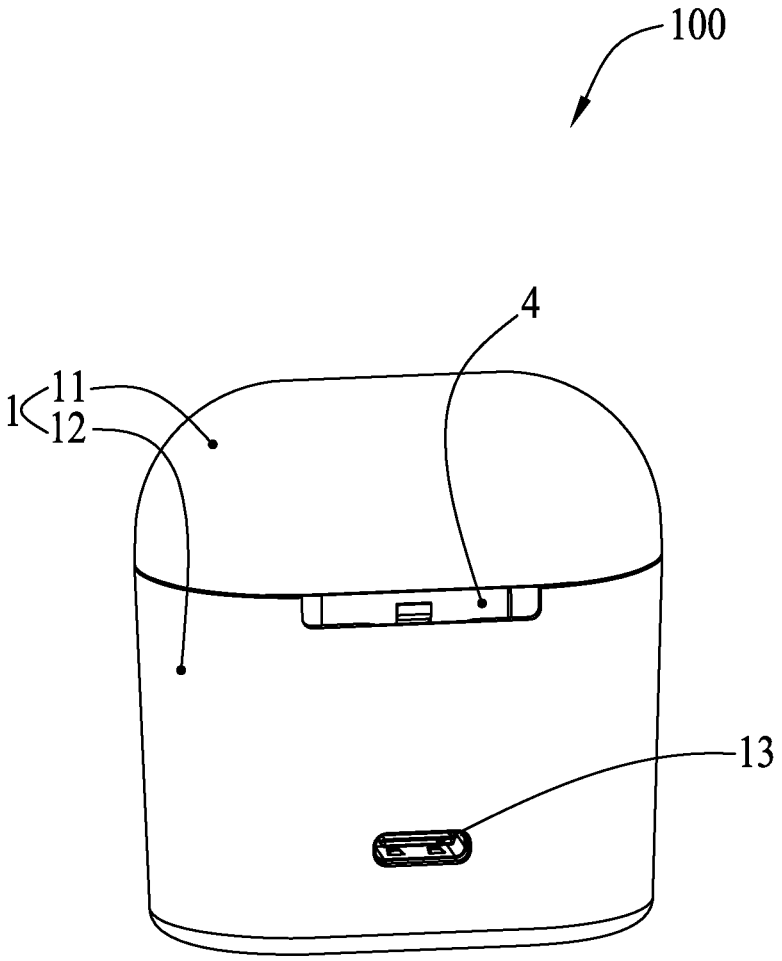
FIG. 2 is a stereo rear view of a hearing aid charging charger case of the present disclosure.
Figure 3:
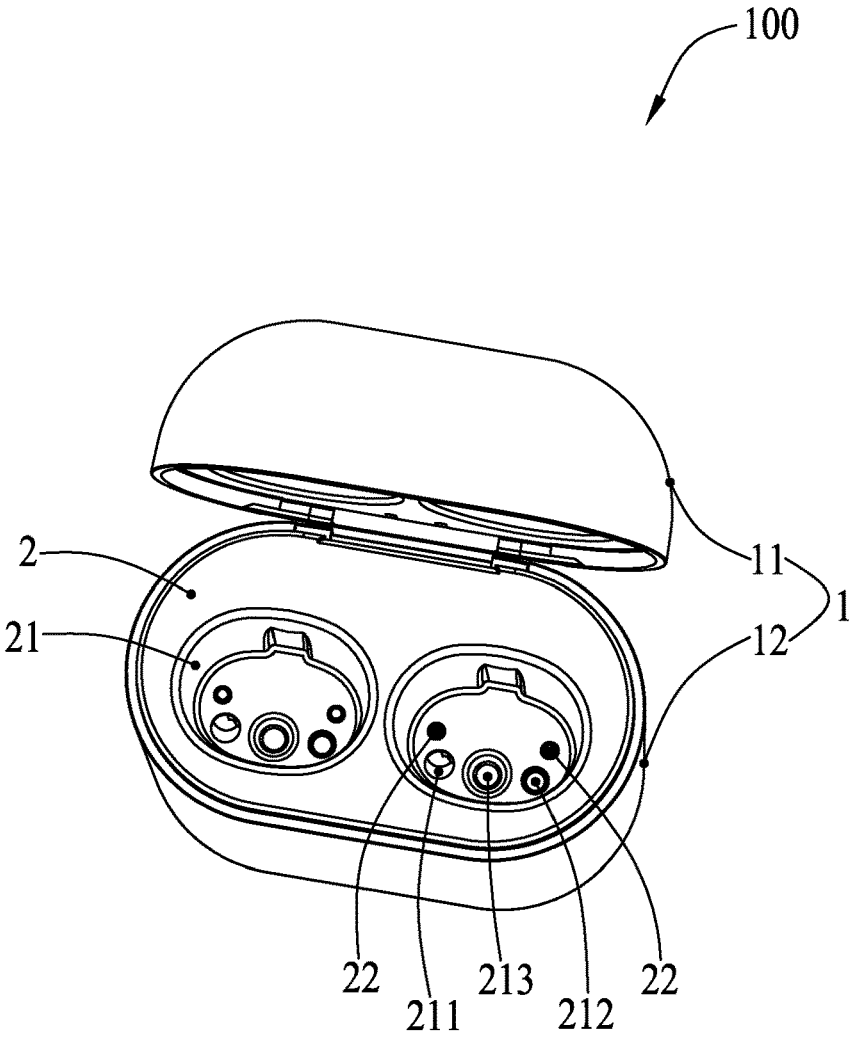
FIG. 3 is a schematic diagram showing an opening state of a hearing aid-charger case of the present disclosure.
Figure 4:
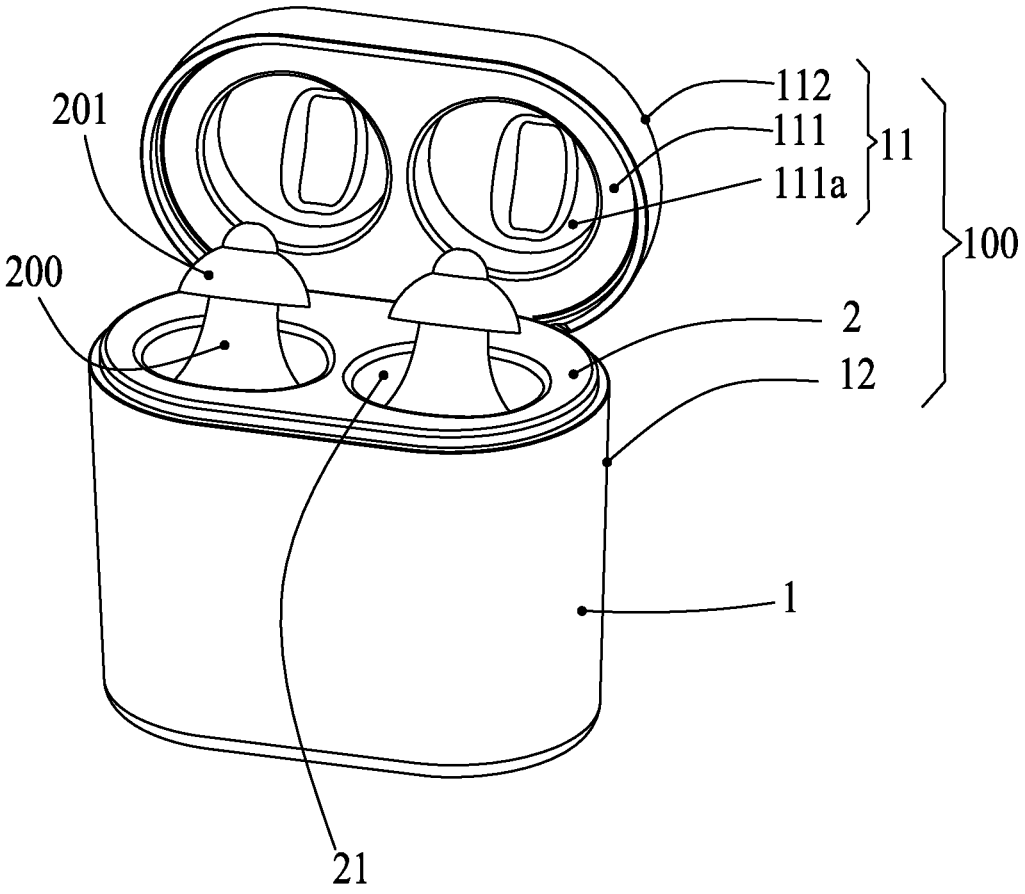
FIG. 4 is a schematic diagram showing a matching state of hearing aids and a hearing aid charger case of the present disclosure.

As shown in FIG. 1, FIG. 2 and FIG. 4, a hearing aid charger case 100 comprises a housing 1, a lining 2, a charger module 3 and a rechargeable battery module 5. The housing 1 comprises a lid body 11 and a lower housing body 12; the lid body 11 and the lower housing body 12 are pivoted to each other through a hinge 4; a back surface of the lower housing body 12 is disposed with a USB interface 13, and the USB interface 13 is electrically connected to the charger module 3. The lower housing body 12 is preferably a light-transmitting material.

As shown in FIG. 1 to FIG. 5 and FIG. 9, the lining 2 and the charger module 3 are arranged in the lower housing body 12, the lining 2 is located above the charger module 3 and is fixedly connected to the charger module 3, and the lining 2 is disposed with two charging bays 21. The bottom of each charging bay 21 is disposed with two charging pins 22, a through hole 211, a notch 212 and a recess 213. Each charging pin 22 is electrically connected to the charger module 3. The rechargeable battery module 5 is electrically connected to the charger module 3, and the rechargeable battery module 5 can supply power to the charging pins 22. A hearing aid 200 has an ear mold head 201 and a hearing aid body 202. An end surface of the hearing aid body 202 on the contact side with charger case 100 comprises two spaced charging contacts 2021, a microphone hole 2022, a volume adjustment knob 2023 and a take-out line 2024. An inner wall of the charging bay 21 matches with an outer wall of the hearing aid body 202. The positions of the two charging pins 22 correspond to the positions of the two charging contacts 2021 of the hearing aid 200, and each charging pin 22 is electrically connected to the charger module 3. When the hearing aid 200 is placed in the charging bay 21, the two charging contacts 2021 are in contact with the two charging pins 22. Given the easy contact connection, simply by having the two charging pins 22 touch the two charging contacts 2021, the charging can be achieved. The microphone 2022 is disposed in the notch 212, the volume adjustment knob 2023 is placed in the recess 213, and the through hole 211 is used to accommodate the take-out line 2024. The two charging bays 21 can be used to charge two hearing aids 200 at once. The lid body 11 comprises an upper lining 111 and a lid 112. The lid 112 is arranged outside the upper lining 111 and is fixedly connected to the upper lining 111. An inner side face of the upper lining 111 sinks in and forms two grooves 111*a*, and the two grooves 111*a* and the two charging bays are arranged one for each. The groove 111*a* matches with the ear mold head 201 of the hearing aid 200. When the groove 111*a* accommodates the ear mold head 201 of the hearing aid 200, the charging bay 21 matches with the hearing aid body 202. The charger case 100 plays a role of charging and storing the hearing aid 200 at the same time.

Figure 7:
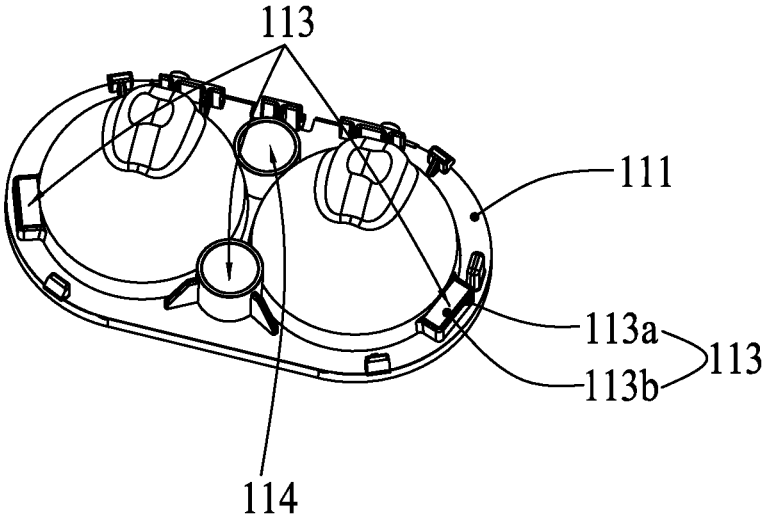
FIG. 7 is a schematic diagram of a back surface of an upper lining in the present disclosure.
Figure 8:
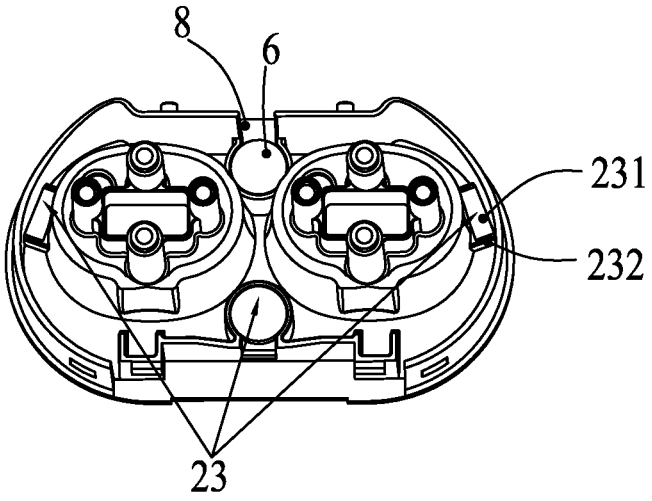
FIG. 8 is a schematic diagram of a back surface of a lining in the present disclosure.
Figure 9:
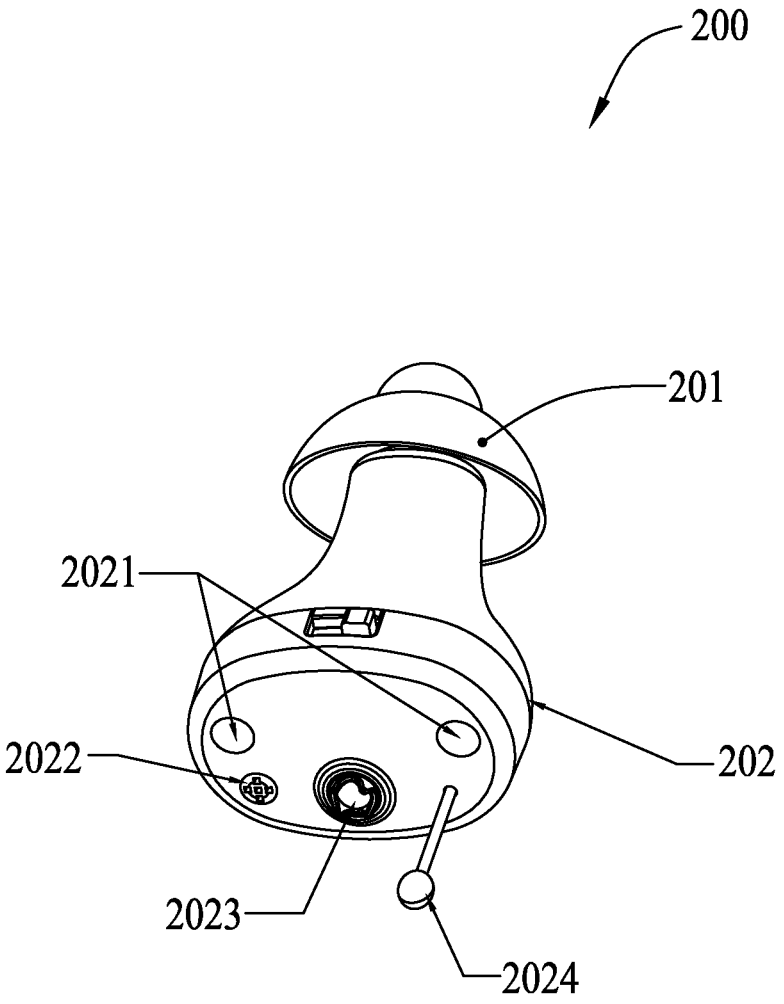
FIG. 9 is a schematic diagram showing the structure of a hearing aid in the present disclosure.

As shown in FIG. 7, FIG. 8 and FIG. 4, a back surface of the upper lining 111 is disposed with a plurality of first magnetic mechanisms 113. A back surface of the lining 2 is disposed with a plurality of second magnetic mechanisms 23. The first magnetic mechanisms 113 and the second magnetic mechanisms 23 are arranged in one-to-one correspondence, and the upper lining 111 and the lining 2 are connected to each other through the first magnetic mechanisms 113 and the second magnetic mechanisms 23. The first magnetic mechanism 113 has a first magnetic slot 113*a* and a first magnet 113*b* placed in the first magnetic slot 113*a*. The second magnetic mechanism 23 has a second magnetic slot 231 and a second magnet 232 placed in the second magnetic slot 231.

Figure 5:
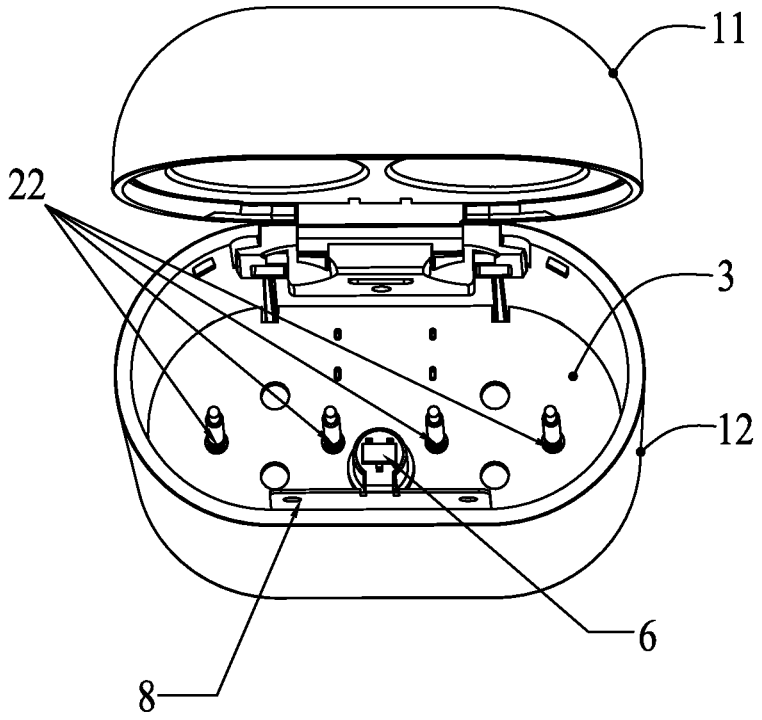
FIG. 5 is a schematic diagram showing an opening state of a hearing aid charger case of the present disclosure (when a lining is removed).
Figure 6:
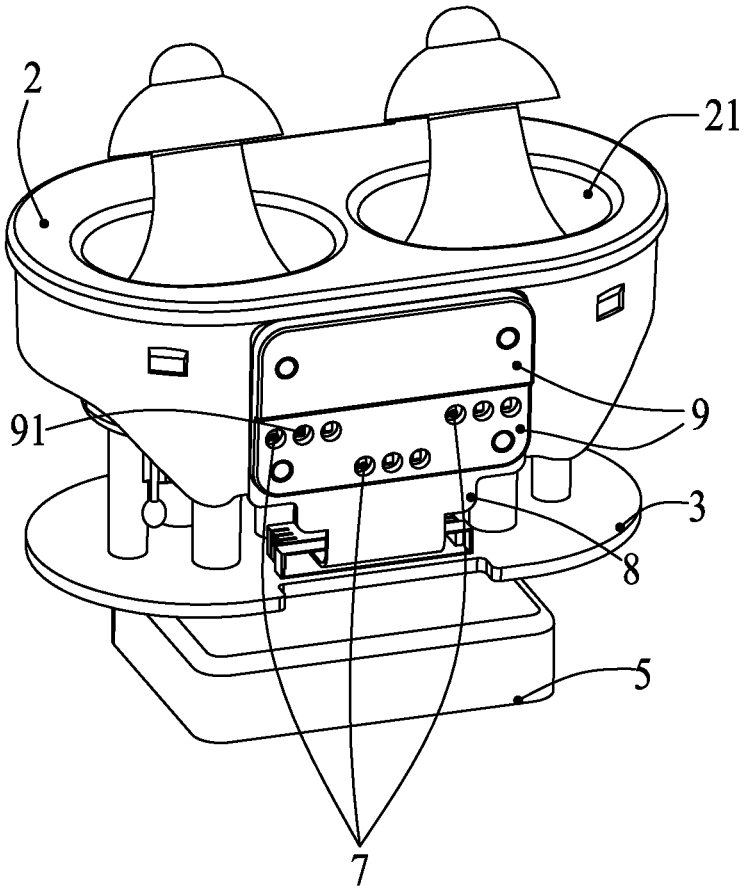
FIG. 6 is a schematic diagram of a hearing aid charger case of the present disclosure (when a housing is removed).

As shown in FIG. 5, FIG. 6 and FIG. 4, the lower housing body 12 is internally provided with a Hall switch 6, three LED sets 7 and a light shielding plate 9. The Hall switch 6 is located at the top of the lining 2, and the Hall switch 6 and the three LED sets 7 are respectively welded on a flexible printed circuit (FPC) board 8. The FPC board 8 is electrically connected to the charging module 3. A back surface of the upper lining 111 for the lid body 11 relative to the Hall switch 6 is disposed with a third magnetic mechanism, and the third magnetic attachment mechanism 114 and the Hall switch 6 are correspondingly arranged. The charger module 3 is provided with a battery level detection module to detect battery level. Each LED set 7 comprises three LED beads 91, and the number of the LED beads 91 turned-on indicates the battery level. The Hall switch 6 exerts functions of switching on or off the charger module 3 when the lid of the charger case 100 is opened or closed, which turns on or off the LED. Two of the three LED lamp 7 are respectively used to indicate charging states of the two hearing aids, while the other LED set is used to indicate a charging state of the rechargeable battery module 5. The three LED beads 91 of each LED set 7 are used to indicate the battery level. When the battery is fully charged, the three LED beads 91 are turned on at the same time. When the battery isn't fully charged, only one or two LED beads 91 are turned on. The battery level detection module is used to indicate the battery level of the two hearing aids and rechargeable battery module 5, and the number of LED beads 91 turned on in each LED set 7 indicates the battery level.

The light shielding plate 9 is arranged in front of the FPC board 8, and each LED set 7 exposes from the light shielding plate 9. The light shielding plate 9 is used to prevent that due to the diffusion of the LED lights, the LED lights can't transmit outside the housing 1 of the charger case 100.

The charger case 100 of the present disclosure can be used to charge and store the two hearing aids 200. It integrates charging and storage into one body, which is convenient to carry around. When there is no power supply, the two hearing aids 200 can be charged with the spare rechargeable battery module 5.

Herein, only preferred embodiments of the disclosure are described, and the scope to be claimed cannot be limited thereto. Thus, any equivalent change to the embodiments still falls within in the scope covered by the claims.

What is claimed is:

1. A hearing aid charging case, wherein a hearing aid has an ear mold head and a hearing aid body; an end surface of the hearing aid body on the contact side with the charger case comprising two spaced charging contacts, a microphone hole, a volume adjustment knob and a take-out line; the charger case comprising a housing, a lining and a charger module, the housing comprising a lid body and a lower housing; the lid body and the lower housing body being pivoted to each other through a hinge; a back surface of the lower housing body being disposed with a power interface connected to power supplies, and the power-interface is electrically connected to the charger module; the lining and the charger module being arranged in the lower housing body, the lining being located above the charger module and fixedly connected to the charger module, and the lining being disposed with two charging bays; the bottom of each charging bay being disposed with two charging pins, a through hole, a notch and a recess; the positions of the two charging pin corresponding to the positions of the two charging contacts of the hearing aid, and each charging pin being electrically connected to the charger module; the through hole being used to accommodate the take-out line, the notch being used to accommodate the microphone, and the recess being used to accommodate the volume adjustment knob.

2. The hearing aid charging case according to claim 1, wherein the lower housing body further comprising a rechargeable battery module, the rechargeable battery module being electrically connected to the charger module, and the rechargeable battery module supplying power to the charging pins.

3. The hearing aid charger case according to claim 1, wherein the lid body further comprising an upper lining and a lid, and the lid being disposed outside the upper lining and fixedly connected with the upper lining; a back surface of the upper lining being disposed with a plurality of first magnetic mechanisms; a back surface of the lining being dispose with a plurality of second magnetic mechanism; the first magnetic mechanisms and the second magnetic mechanisms being arranged in one-to-one correspondence, and the upper lining and the lining being connected to each other through the first magnetic mechanisms and the second magnetic mechanisms.

4. The hearing aid charger case according to claim 3, wherein an inner side face of the upper lining sinking in and forming two grooves, the grooves being used to accommodate the ear mold heads of the hearing aids, the two grooves and the two charging bays being arranged one for each.

5. The hearing aid charger case according to claim 3, wherein the first magnetic-mechanism having a first magnetic slot and a first magnet placed in the first magnetic slot; the second magnetic mechanism having a second magnetic slot and a second magnet placed in the second magnetic slot.

6. The hearing aid charger case according to claim 2, wherein the lower housing body being internally provided with a Hall switch and three LED sets; each LED set having more than two LED beads; the Hall switch being located at the top of the lining, and the Hall switch and the three LED sets being respectively welded on a flexible printed circuit (FPC) board; the FPC board being electrically connected to the charging module; a back surface of the upper lining for the lid body relative to the Hall switch being disposed with a third magnetic mechanism, and the third magnetic mechanism and the Hall switch being correspondingly arranged; the charger module further having a battery level detection module used to respectively detect the power reserve of the hearing aids and rechargeable battery module; each LED set comprising more than two LED beads, and the number of LED beads turned-on or turned-off in each LED set indicating the battery level.

7. The hearing aid charger case according to claim 6, wherein the lower housing body being a light-transmitting material and provided with a light shielding plate in an area of the LED sets, the light shielding plate being arranged in front of the FPC board, and each LED set exposing from the light shielding plate.

* * * * *